US009517500B2

(12) United States Patent
Neal et al.

(10) Patent No.: US 9,517,500 B2
(45) Date of Patent: Dec. 13, 2016

(54) METHOD AND APPRARATUS FOR FORMING A HELICAL TUBE BUNDLE

(71) Applicants: Kennieth Neal, Mesa, AZ (US); Eugene Neal, Mesa, AZ (US)

(72) Inventors: Kennieth Neal, Mesa, AZ (US); Eugene Neal, Phoenix, AZ (US); Eric Wilderson, Medford, OR (US); James Cunningham, Mesa, AZ (US)

(73) Assignees: Kennieth Neal, Mesa, AZ (US); Eugene Neal, Mesa, AZ (US)

( * ) Notice: Subject to any disclaimer, the term of this patent is extended or adjusted under 35 U.S.C. 154(b) by 346 days.

(21) Appl. No.: 14/493,898

(22) Filed: Sep. 23, 2014

(65) Prior Publication Data

US 2016/0082493 A1 Mar. 24, 2016

(51) Int. Cl.

| | |
|---|---|
| ***B21D 11/06*** | (2006.01) |
| ***B21D 11/14*** | (2006.01) |
| ***B21D 53/02*** | (2006.01) |
| ***B21D 53/06*** | (2006.01) |
| ***B21D 7/04*** | (2006.01) |
| ***B21D 7/08*** | (2006.01) |
| ***B21D 7/12*** | (2006.01) |

(52) U.S. Cl.

CPC ..... *B21D 11/06* (2013.01); *B21D 7/04* (2013.01); *B21D 7/08* (2013.01); *B21D 7/12* (2013.01); *B21D 11/14* (2013.01); *B21D 53/027* (2013.01); *B21D 53/06* (2013.01)

(58) Field of Classification Search

CPC ..... B21D 11/06; B21D 11/10; B21D 11/14; B21D 53/02; B21D 53/027; B21D 53/06; B21D 7/04; B21D 7/08; B21D 7/12; B21D 9/10; B21F 7/00; B21F 15/02; B21F 15/04; B21F 3/02; B21F 3/12; H01B 13/0207; H01B 13/0214; H01B 13/0221; H01B 13/0228

USPC ..... 72/64, 65; 140/149

See application file for complete search history.

(56) References Cited

U.S. PATENT DOCUMENTS

| | | | | | |
|---|---|---|---|---|---|
| 300,741 | A * | 6/1884 | Spruce | B21D 11/14 | 140/149 |
| 1,148,121 | A * | 7/1915 | Porter | B21D 11/14 | 72/224 |
| 2,437,500 | A | 3/1948 | Bruegger | | |
| 2,724,944 | A * | 11/1955 | Carleton | D07B 3/04 | 57/138 |
| 2,815,790 | A | 12/1957 | Mayrath | | |
| 3,370,622 | A * | 2/1968 | Marks | B21F 7/00 | 140/149 |
| 3,415,092 | A | 12/1968 | Dean | | |

(Continued)

*Primary Examiner* — Jimmy T Nguyen
*Assistant Examiner* — Gregory Swiatocha
(74) *Attorney, Agent, or Firm* — Hartman Titus PLC; John D. Titus

(57) ABSTRACT

Apparatus and method for forming a plurality of elongate members into a helical bundle in which a pair of bending die assemblies are mounted on a moveable carriage, the moveable carriage itself being supported by a frame. The bending dies each have a plurality of grooved rollers that engage the sides of the tubes to apply a bending force while allowing the tubes to move longitudinally through the die assemblies. The die assemblies can be rotated independent of each other or in unison by means of stepper motors. A collet, attached to the frame, holds the ends of the tubes during the bending operation.

9 Claims, 8 Drawing Sheets

(56) References Cited

U.S. PATENT DOCUMENTS

| | | | | | |
|---|---|---|---|---|---|
| 4,402,205 | A | | 9/1983 | Yakovlev | |
| 4,606,209 | A | | 8/1986 | Eisinger | |
| 4,757,700 | A | | 7/1988 | Dotti | |
| 4,843,713 | A | * | 7/1989 | Langner | D07B 3/00 29/469 |
| 4,865,081 | A | * | 9/1989 | Neumann | B04B 5/0442 138/103 |
| 5,052,450 | A | * | 10/1991 | Williams | H01B 13/0257 140/149 |
| 5,465,597 | A | | 11/1995 | Bajraszewski | |
| 7,165,605 | B2 | * | 1/2007 | Park | F28D 7/0008 165/140 |
| 7,458,242 | B2 | * | 12/2008 | Rataj | B21F 5/00 140/149 |
| 2011/0011572 | A1 | * | 1/2011 | Nagurny | F28D 7/024 165/172 |

* cited by examiner

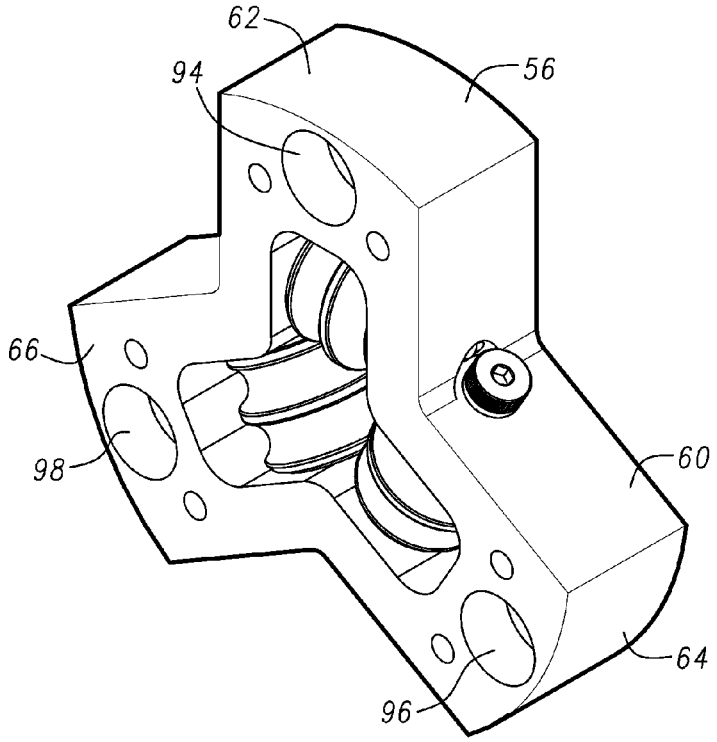
FIG. 6
FIG. 7
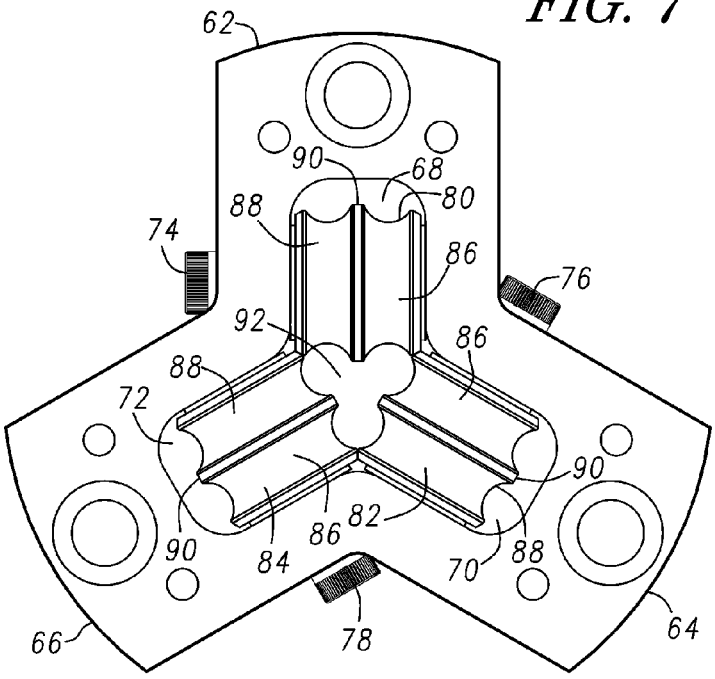

METHOD AND APPRARATUS FOR FORMING A HELICAL TUBE BUNDLE

BACKGROUND OF THE INVENTION

This invention relates generally to methods and devices used for forming elongate wire, rod, tubing and the like into shapes, in particular forming wire or tubing into helical shapes.

As disclosed in U.S. patent application Ser. No. 13/864,018, the contents of which are incorporated herein by reference, a heat exchanger in which the heat exchanger tubes are formed into helical tube bundles has significant advantages over straight-tube heat exchangers in terms of durability, size and thermal efficiency.

Apparatus and methods for forming a single rod of wire or tube into a helical shape are well known. U.S. Pat. No. 4,402,205 to Yakovlev et al. discloses various methods for forming helical springs by winding a resilient rod around a rotating mandrel. U.S. Pat. No. 4,606,209 to Eisinger discloses a disk roller mechanism for forming a wire into a helical shape in which the wire is drawn through a plurality of staggered disk-shaped forming rollers while the wire is also being rotated about its own axis. Although the prior art discloses numerous methods of forming a single wire into a helix, or multiple thin strands into wire rope, the prior art does not disclose a method and apparatus for simultaneously forming a plurality of tubes into a helical bundle.

SUMMARY OF THE INVENTION

The present invention comprises an apparatus and method for forming a plurality of rigid or semi-rigid elongate members, for example a plurality of stainless steel tubes, into a helical bundle. According to an illustrative embodiment, a pair of bending die assemblies are mounted on a moveable carriage, the moveable carriage itself being supported by a frame. The bending dies each have a plurality of grooved rollers that engage the sides of the tubes to apply a bending force while allowing the tubes to move longitudinally through the die assemblies. The die assemblies can be rotated independent of each other or in unison by means of stepper motors. A collet, attached to the frame, holds the ends of the tubes during the bending operation.

With the tubes firmly held by the collet, the first bending die assembly is rotated about the axis of the tube bundle until the lead angle of the helix is established, taking into account the elastic recovery of the tubes. Thereafter, both bending die assemblies are rotated in unison as the carriage is advanced along the axis of the tube bundle. The pitch (helical angle) of the tube bundle can be varied by varying the spacing of the bending die assemblies, the angular orientation between the two bending die assemblies and/or by varying the speed of advancement of the carriage relative to the rotation of the die assemblies. The helical radius of the tube bundle can be adjusted by altering the depth of the grooved rollers.

BRIEF DESCRIPTION OF THE DRAWING

The present invention will be better understood from a reading of the following detailed description, taken in conjunction with the accompanying drawing figures in which like references designate like elements and, in which:

FIG. 6 is a perspective view of an alignment die used in the bending apparatus of FIG. 1;

FIG. 7 is a front view of the alignment die of FIG. 6;

DETAILED DESCRIPTION

Figure 1:
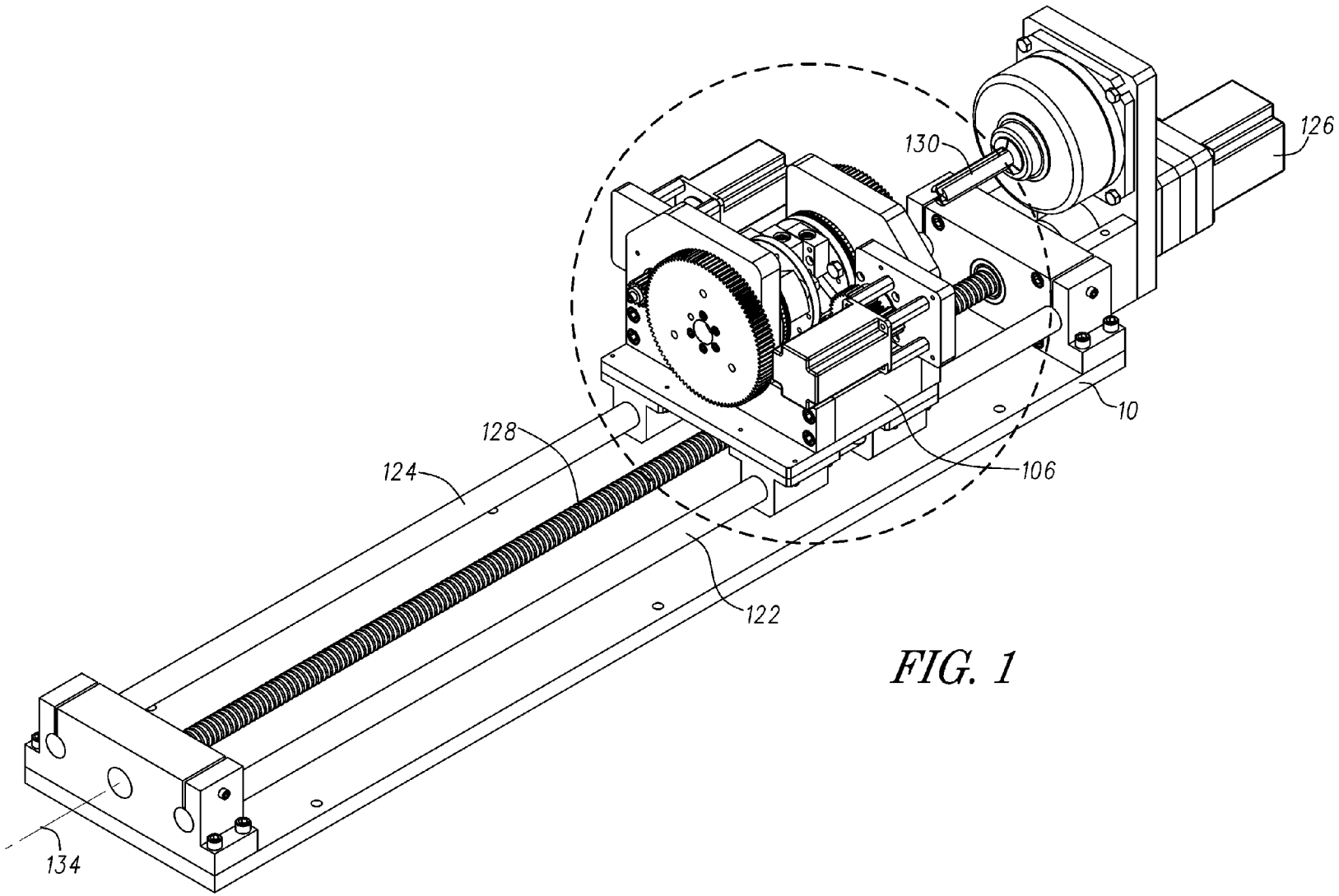
FIG. 1 is a front perspective view of a bending apparatus incorporating features of the present invention.

The drawing figures are intended to illustrate the general manner of construction and are not necessarily to scale. In the detailed description and in the drawing figures, specific illustrative examples are shown and herein described in detail. It should be understood, however, that the drawing figures and detailed description are not intended to limit the invention to the particular form disclosed, but are merely illustrative and intended to teach one of ordinary skill how to make and/or use the invention claimed herein and for setting forth the best mode for carrying out the invention.

Figure 2:
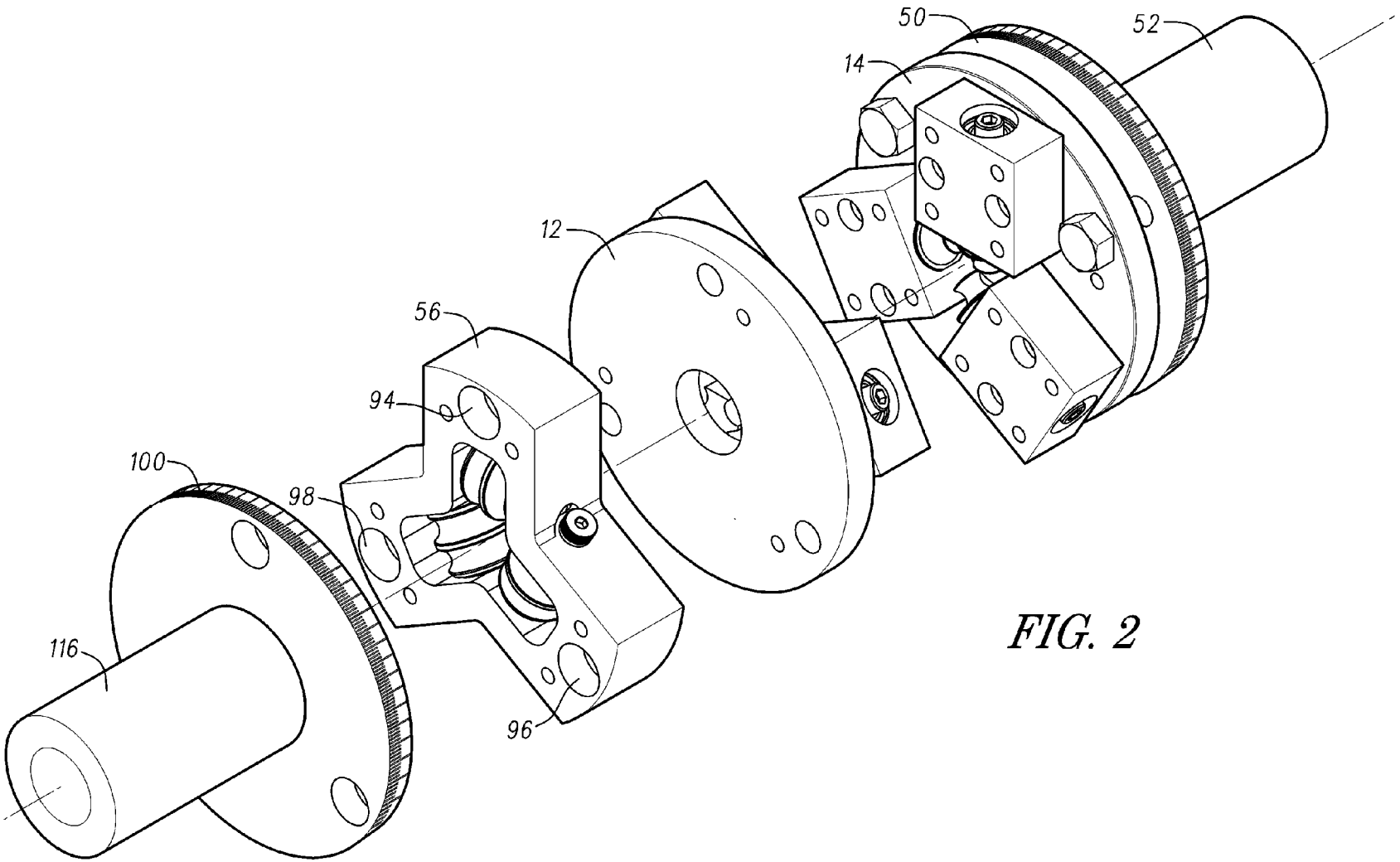
FIG. 2 is an exploded perspective view of a portion of the bending apparatus of FIG. 1.
Figure 3:
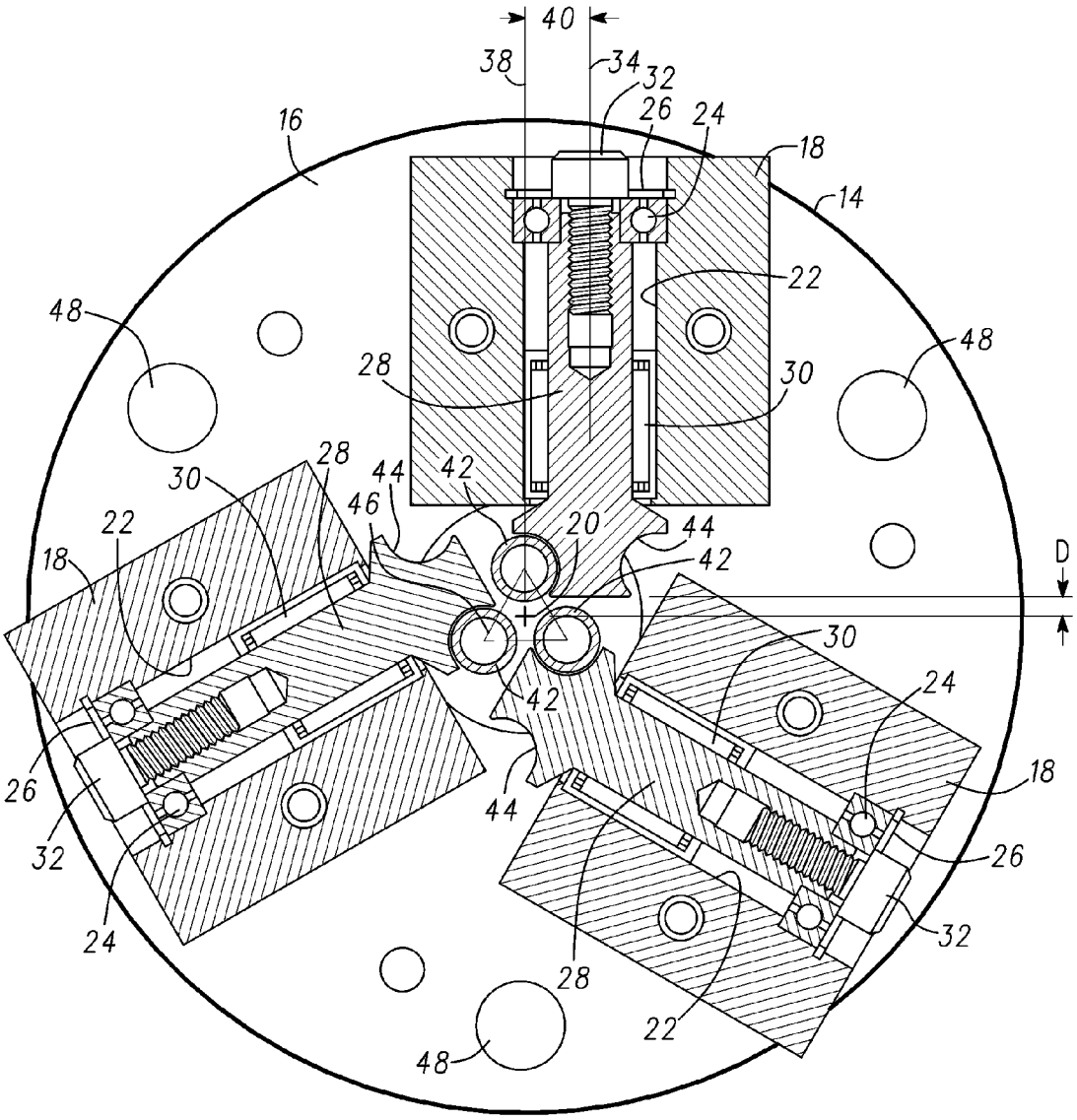
FIG. 3 is a cross sectional view of a bending die used in the bending apparatus of FIG. 1.
Figure 5:
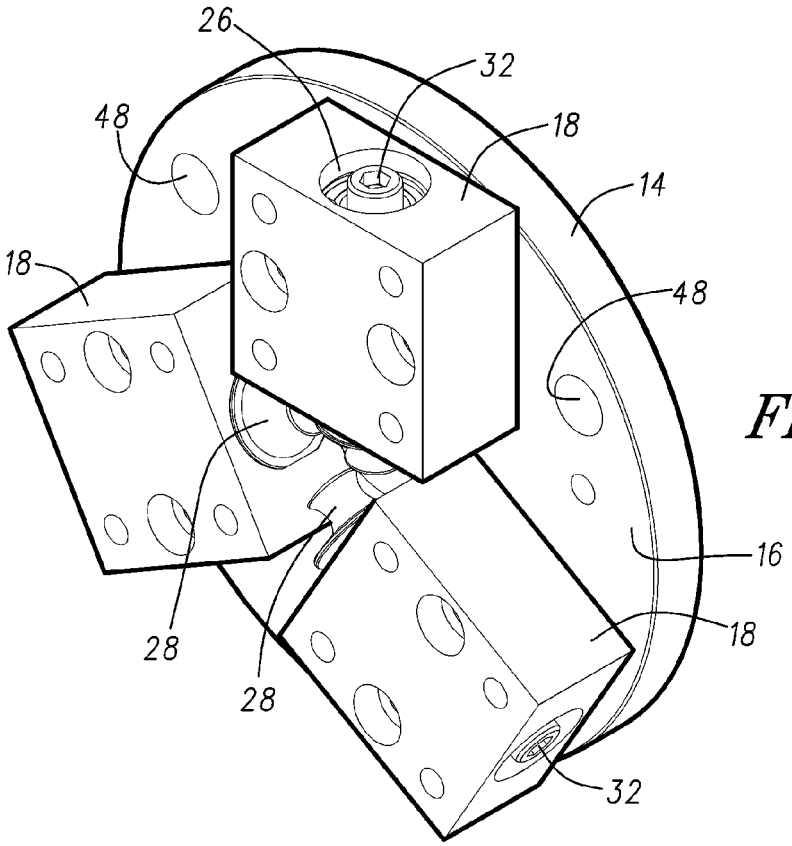
FIG. 5 is a perspective view of the bending die of FIG. 3.
Figure 4:
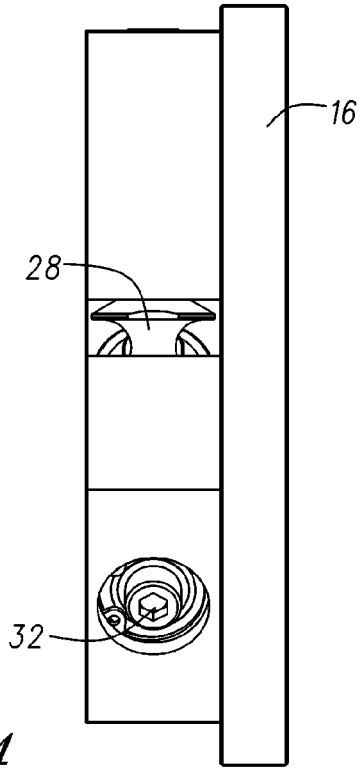
FIG. 4 is a side view of the bending die of FIG. 3.
Figure 8:
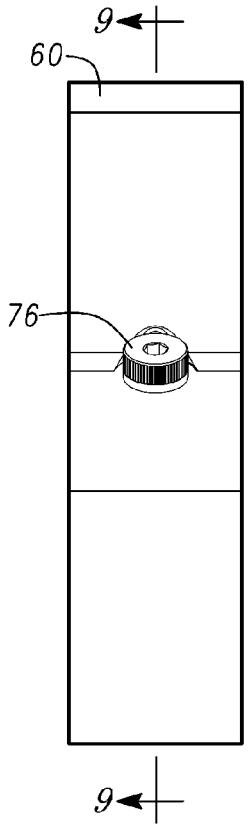
FIG. 8 is a side view of the alignment die of FIG. 6.
Figure 9:
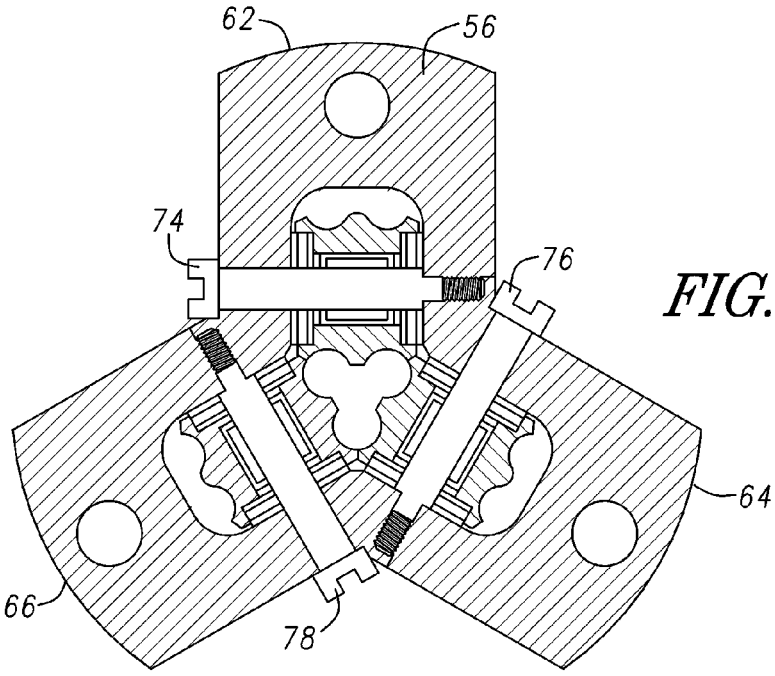
FIG. 9 is a cross-sectional view of the alignment die of FIG. 6.

With reference to the figures and in particular FIGS. 1-2, apparatus 10 comprises a front bending die assembly 12 and a rear bending die assembly 14. With further reference to FIGS. 3-5, rear bending die assembly 14 comprises a die mounting plate 16 which supports a plurality of bearing blocks 18 arranged in a circular array about helical axis 20. In the illustrative embodiment, there are three bearing blocks bolted to die mounting plate 16 for forming a helical bundle of three cylindrical tubes having the same diameter, however, it is not intended that the invention be limited to forming bundles of any particular number of elongate members, that the elongate members be tubes, that the elongate members be cylindrical, or if cylindrical that they be of the same diameter.

Each of bearing blocks 18 has a central bore 22 which supports a ball bearing 24 retained in central bore 22 by a snap ring 26. A bending die comprising a grooved roller 28 is disposed in central bore 22 supported at one end by ball bearing 24 and the other end by a needle roller bearing 30. A die retaining screw 32 secures grooved roller 28 to bearing block 18. Collectively the grooved rollers 28 form guideways that exert a lateral force for bending tubes 42 while allowing tubes 42 to pass through bending die assembly 14. Although the illustrative embodiment discloses grooved rollers supported by ball bearings and needle roller bearings, other art-recognized equivalents may be substituted without departing from the scope of the invention, for example a non-roller supported forming die may be used, provided sufficient lubrication is applied to prevent galling of the surfaces of the tubes being formed. Accordingly, it is not intended that the invention be limited to the particular method of supporting the bending dies disclosed in the illustrative embodiment.

As can be determined from an inspection of FIG. 3 the axis 34 of central bore 22 is offset from a radial line 38 extending outward from helical axis 20 by a distance 40 so that the lateral force applied by grooved roller 28 to the tubes 42 is primarily a side load reacted by roller bearing 30 with little or no axial load on ball bearing 24. The profile of grooved portion 44, the offset distance 40, and the depth "D" of grooved rollers 28 may be adjusted to accommodate tube bundles of varying dimensions and the orientation of bearing blocks 18 can be reversed for producing helical bundles of right hand or left hand twist. As can also be determined from an inspection of FIG. 3, the grooved portion 44 of grooved roller 28 comprises a semicircular groove having a radius equal to or slightly smaller than the radius of the tubes 42 being formed in the apparatus 10, as is customary in rotary draw bending applications. The center of curvature of the grooved portions 44 therefore form an equilateral triangle 46 having side substantially equal to 2R+t where R is the radius of the tubes being formed and "t" is the spacing between the tubes. Die mounting plate 16 further comprises a plurality of mounting holes 48 to enable die mounting plate to be attached to the axle flange 50 as more fully described hereinafter. Front bending die assembly 12 is substantially identical in construction and therefore will not be discussed in detail herein.

With additional reference to FIGS. 6-9, apparatus 10 further includes an alignment die 56. Alignment die 56 comprises a solid body 60 having three lobes 62, 64 and 66 each of which includes an aperture 68, 70, 72. Apertures 68, 70, 72 each have an axle 74, 76, 78 which supports a roller 80, 82, 84. Rollers 80, 82, 84 each comprise a pair of semicircular cutouts 86, 88 separated by a central flange 90. The semicircular cutouts 86, 88 together with the central flange 90 of rollers 80, 82, 84 collectively form a tri-lobed guideway 92 that engages the lateral sides of the tubes 42 to constrain tubes 42 into a bundle while allowing the tubes to pass through alignment die 56. Alignment die further includes mounting holes 94, 96, 98 for mounting alignment die 56 to front axle flange 100.

Figure 10:
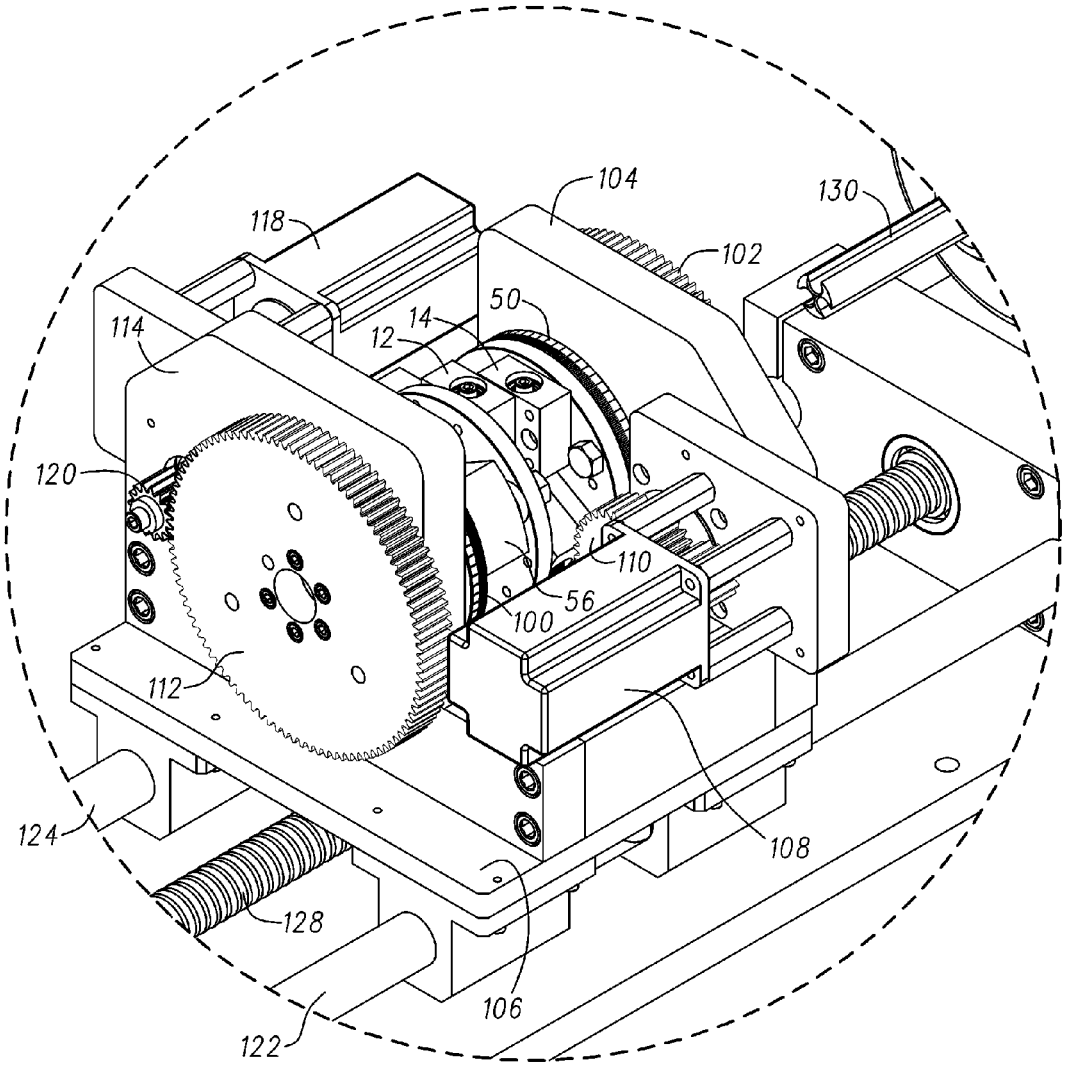
FIG. 10 is an enlarged perspective view of a portion of the bending apparatus of FIG. 1.

With additional reference to FIG. 10, rear axle flange 50 is attached to rear drive gear 102 by means of an axle 52 passing through rear wall 104 of carriage assembly 106. Rear drive gear 102 is driven by a stepper motor 108 through a gear train consisting of rear primary gear 110, and rear primary pinion gear (not shown) which engages rear drive gear 102. Front axle flange 100 is similarly attached to front drive gear 112 by means of an axle 116 passing through front wall 114 of carriage assembly 106. Front drive gear 112 is driven by a stepper motor 118 through a gear train consisting of front primary gear (not shown), and front primary pinion gear 120 which engages front drive gear 112. Carriage assembly 106 is supported by rails 122, 124 and is driven along the rails by means of a conventional gear-reduction stepper motor 126 and lead screw 128.

Figure 11:
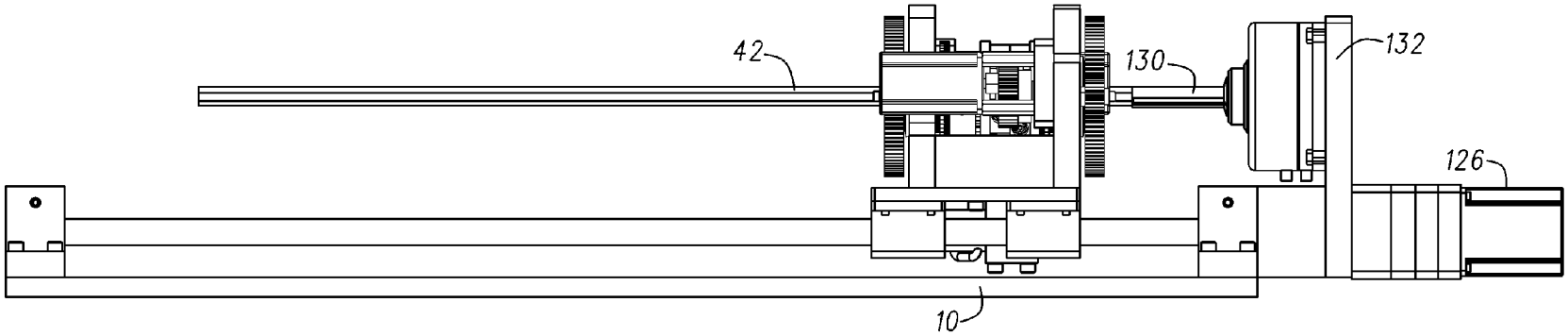
FIG. 11 is a side view of the bending apparatus of FIG. 1 in an initial position.
Figure 12:
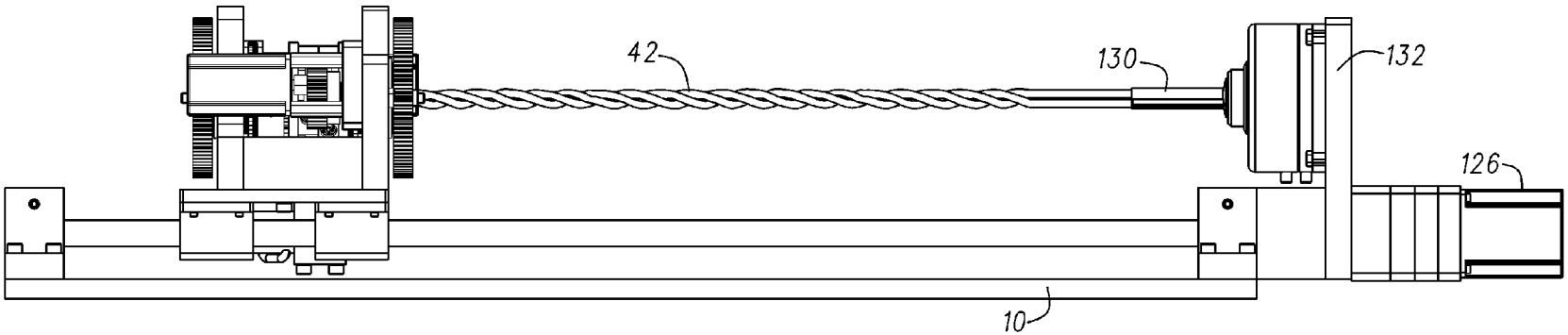
FIG. 12 is a side view of the bending apparatus of FIG. 1 in a final position.

With further reference to FIGS. 11-12, in operation, alignment die 56, front bending die assembly 12 and a rear bending die assembly 14 are oriented so that tubes 42 may be fed through alignment die 56, front bending die assembly 12 and a rear bending die assembly 14 and secured by collet with lead-in die assembly 130 to the frame 132 of apparatus 10. Collet and lead-in die assembly 130 is specially constructed with three recesses for securing the tubes necessary to form a preferred three-tube bundle. Once tubes 42 are secured, a software program running on a general purpose computer (not shown) engages stepper motor 118 to rotate front bending die assembly 12 and alignment die 56 a predetermined amount to establish the helical angle (pitch) of the helical tube bundle taking into account the elastic recovery of the tubes. Once the initial helical angle is established, stepper motor 108 is engaged to rotate rear bending die assembly 14 in unison with front bending die assembly 12 so that the angular orientation between rear bending die assembly 14 and front bending die assembly 12 remains constant. Simultaneously, drive motor 126 engages to drive lead screw 128 which moves carriage assembly 106 along longitudinal axis 134 of apparatus 10 supported by rails 122, 124 until the carriage reaches its final position as shown in FIG. 12.

Although certain illustrative embodiments and methods have been disclosed herein, it will be apparent from the foregoing disclosure to those skilled in the art that variations and modifications of such embodiments and methods may be made without departing from the invention. For example, although in the illustrative embodiment, the angular orientation between rear bending die assembly and front bending die assembly remain constant the angular orientation between rear bending die assembly 14 and front bending die assembly 12 can be varied, and the rotational velocity of the bending die assemblies relative to the speed of the carriage imparted by lead screw 128 can be varied if a variable pitch helical tube bundle is desired. Accordingly, it is intended that the invention should be limited only to the extent required by the appended claims and the rules and principles of applicable law. Additionally, as used herein, references to direction such as "up" or "down" are intend to be exemplary and are not considered as limiting the invention and, unless otherwise specifically defined, the terms "generally," "substantially," or "approximately" when used with mathematical concepts or measurements mean within ±10 degrees of angle or within 10 percent of the measurement, whichever is greater, and as used herein, a step of "providing" a structural element recited in a method claim means and includes obtaining, fabricating, purchasing, acquiring or otherwise gaining access to the structural element for performing the steps of the method.

What is claimed is:

1. Apparatus for forming a plurality of tubes into a helical bundle, the apparatus comprising:

a frame having a longitudinal axis;

a carriage mounted to the frame, the carriage having supports engaging the frame, the supports constraining the carriage to move linearly along the longitudinal axis of the frame;

a first bending die assembly mounted to the carriage, the first bending die assembly having a front surface, a rear surface and a plurality of guideways extending through from the front surface to the rear surface of the first bending die assembly, the guideways engaging the sides of the plurality of tubes to constrain the plurality of tubes laterally while allowing sliding engagement between the guideways and the plurality of tubes along an axis from the front surface to the rear surface of the first bending die assembly;

a second bending die assembly mounted to the carriage, the second bending die assembly having a front surface, a rear surface and a plurality of guideways extending through from the front surface to the rear surface of the second bending die assembly, the guideways engaging the sides of the plurality of tubes to constrain the plurality of tubes laterally while allowing sliding engagement between the guideways and the plurality of tubes along an axis from the front surface to the rear surface of the second bending die assembly;

drive means for rotating the first bending die assembly about an axis parallel to the longitudinal axis of the frame, the axis parallel to the frame defining the longitudinal axis of the helical bundle;

drive means for rotating the second bending die assembly about the longitudinal axis of the helical bundle, the rotation of the second bending die assembly being independent of the rotation of the first bending die assembly; and drive means for moving the carriage linearly along the longitudinal axis of the frame.

2. The apparatus of claim 1, further comprising:

an alignment die assembly mounted to the carriage, the alignment die assembly having a front surface, a rear surface and a plurality of guideways extending through from the front surface to the rear surface of the alignment die assembly, the guideways engaging the sides of the plurality of tubes to constrain the plurality of tubes laterally while allowing sliding engagement between the guideways and the plurality of tubes along an axis from the front surface to the rear surface of the alignment die assembly.

3. The apparatus of claim 2, further comprising:

drive means for rotating the alignment die assembly about the longitudinal axis of the helical bundle.

4. The apparatus of claim 3, wherein:

the alignment die comprises a plurality of flanged rollers, each of the plurality of flanged rollers being mounted for rotation about a rotational axis that is tangent to a circle disposed about and normal to the longitudinal axis of the helical bundle.

5. The apparatus of claim 4, wherein:

the flanged rollers each further comprise a plurality of semicircular grooves disposed on opposite sides of the flanges.

6. The apparatus of claim 1, wherein:

the first bending die comprises a plurality of grooved rollers, each of the plurality of grooved rollers being mounted for rotation about a rotational axis that is offset laterally from a radial line extending from the longitudinal axis of the helical bundle.

7. The apparatus of claim 6, wherein:

the second bending die comprises a plurality of grooved rollers, each of the plurality of grooved rollers being mounted for rotation about a rotational axis that is offset laterally from a radial line extending from the longitudinal axis of the helical bundle.

8. The apparatus of claim 1, wherein:

the drive means for rotating the first bending die comprises a ring gear operatively attached to a stepper motor.

9. A method of forming a plurality of tubes into a helical tube bundle having a common helical axis comprising:

inserting the plurality of tubes into a first bending die assembly mounted to a moveable carriage, the first bending die assembly having a front surface, a rear surface and a plurality of guideways extending through from the front surface to the rear surface of the first bending die assembly, the guideways engaging the sides of the plurality of tubes to constrain the plurality of tubes laterally while allowing sliding engagement between the guideways and the plurality of tubes along an axis from the front surface to the rear surface of the first bending die assembly;

further inserting the plurality of tubes into a second bending die assembly mounted to the carriage, the second bending die assembly having a front surface, a rear surface and a plurality of guideways extending through from the front surface to the rear surface of the second bending die assembly, the guideways engaging the sides of the plurality of tubes to constrain the plurality of tubes laterally while allowing sliding engagement between the guideways and the plurality of tubes along an axis from the front surface to the rear surface of the second bending die assembly;

rotating the first bending die assembly about the common helical axis while maintaining the second bending die assembly rotationally fixed; and further rotating the first bending die assembly while rotating the second bending die assembly in unison with the first bending die assembly and advancing the carriage along the common helical axis.

* * * * *